US006540539B2

(12) United States Patent
Yahiro et al.

(10) Patent No.: US 6,540,539 B2
(45) Date of Patent: Apr. 1, 2003

(54) CONNECTOR HAVING AN ALIGNMENT FUNCTION FOR A SMALL BOARD TO BE CONNECTED THERETO

(75) Inventors: Yasufumi Yahiro, Musashimurayama (JP); Akihiro Matsunaga, Tachikawa (JP); Keiichiro Suzuki, Kodaira (JP); Atsushi Iiyama, Akishima (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 09/896,028

(22) Filed: Jun. 29, 2001

(65) Prior Publication Data

US 2002/0009914 A1 Jan. 24, 2002

(30) Foreign Application Priority Data

Jul. 12, 2000 (JP) ..... 2000-211452
Nov. 15, 2000 (JP) ..... 2000-347487

(51) Int. Cl.[7] ..... H01R 13/62
(52) U.S. Cl. ..... 439/326; 439/385
(58) Field of Search ..... 439/326–328, 439/385, 633, 637

(56) References Cited

U.S. PATENT DOCUMENTS 5,096,435 A * 3/1992 Noschese et al. ..... 439/260
5,586,893 A * 12/1996 Mosquera ..... 439/108
5,803,761 A * 9/1998 Mochizuki ..... 439/326
6,231,364 B1 * 5/2001 Liu ..... 439/326

FOREIGN PATENT DOCUMENTS

JP 2757121 3/1998 ..... H01R/13/639

* cited by examiner

*Primary Examiner*—Khiem Nguyen
(74) *Attorney, Agent, or Firm*—Michael, Best & Friedrich, LLC

(57) ABSTRACT

A connector is adapted to connect a small board (1) inserted in a first direction (A1) and is provided with an elastic member (13) for pressing opposite ends of the small board in a second direction (A2) when the small board is inserted into an insulator housing (3). The small board is inserted into the housing to be faced to conductive contacts fixed to the housing. Upon insertion, the small board is positioned with respect to the contacts by means of the elastic member. Thereafter, the small board is rotated in a thickness direction around its part inserted into the housing to connect the small board and the contacts.

6 Claims, 20 Drawing Sheets

CONNECTOR HAVING AN ALIGNMENT FUNCTION FOR A SMALL BOARD TO BE CONNECTED THERETO

BACKGROUND OF THE INVENTION

This invention relates to a connector for connecting a small board with a memory module mounted thereon and, in particular, to a connector in which a small board is inserted into a housing to be faced to a contact and then rotated in a thickness direction to be connected to the contact.

A connector of the type is disclosed, for example, in Japanese patent No. 2757121. The connector disclosed therein is used to connect a small board with a memory module mounted thereon to a main board. The connector comprises an insulator housing and an electroconductive contact fixed to the housing. In order to connect the small board to the connector, a connecting operation is carried out in the following manner. At first, the small board is partially inserted into a coupling portion of the housing to be faced to the contact. Thereafter, the small board is rotated in a thickness direction around its part inserted into the housing so that a contacting point of the small board is pressed against the contact. Thus, the connecting operation of the small board and the contact is completed. In this state, the small board is engaged with the housing by the use of a latch to be prevented from being released therefrom.

With the connector of the type described, the small board can be inserted into the connector in a direction inclined with respect to the main board after the connector is attached to the main board With this structure, insertion of the small board is easy as compared with a connector of such a type that the small board is inserted in parallel to the main board. In addition, the connector can be designed assuming small friction upon insertion of the small board into the connector. Thus, the small board can be inserted with small force. Upon completion of the connecting operation, the small board is pressed against the contact under sufficiently large contacting force.

However, due to the variation in outer dimension of the small board and the variation in size of the coupling portion of the connector, a positioning error may possibly be caused between the contacting point of the small board and the contact of the connector when the small board is coupled to the connector. The positioning error will result in a contact failure and must be prevented.

SUMMARY OF THE INVENTION

It is therefore an object of this invention to provide a connector capable of automatically positioning a small board when it is inserted and thereafter rotating the small board to achieve electrical connection.

Other object of the present invention will become clear as the description proceeds.

According to this invention, there is provided a connector for connecting a small board with, after inserted into the connector in a first direction, the small board being rotated in a thickness direction around a part thereof which is inserted into the connector. The connector comprises an insulator housing for receiving therein the part of the small board in the first direction and an elastic member held by the housing and having elasticity in a second direction intersecting with the first and the thickness direction. The elastic member is engaged with the small board to position the small board in the second direction when the small board is received in the insulator housing. The connector further comprises an electroconductive contact held by the housing to face in the thickness direction the small board that is received in the insulator.

DESCRIPTION OF THE PREFERRED EMBODIMENTS

Referring to FIGS. 1A to 3B, description will be made of a connector according to a first embodiment of this invention.

Figure 1A:
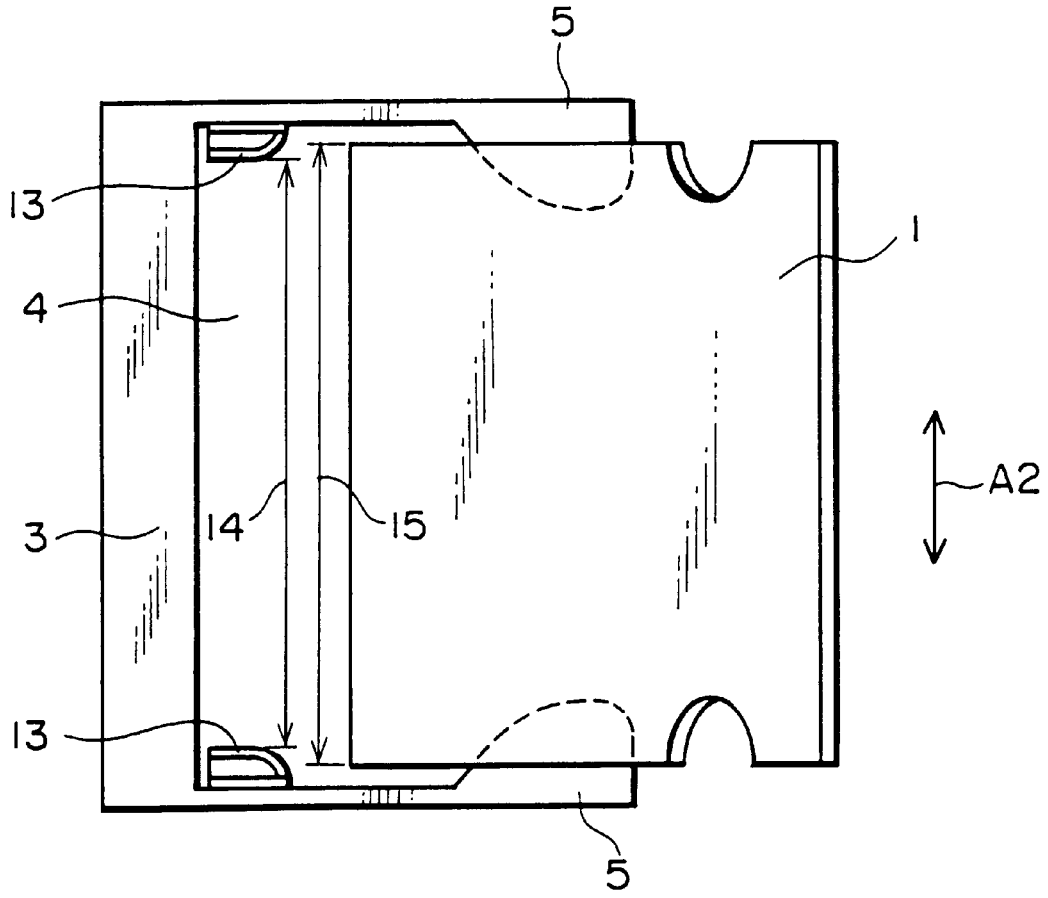
FIGS. 1A and 1B are a plan view and a side view showing a connector according to a first embodiment of this invention before a small board is inserted therein, respectively.
Figure 1B:
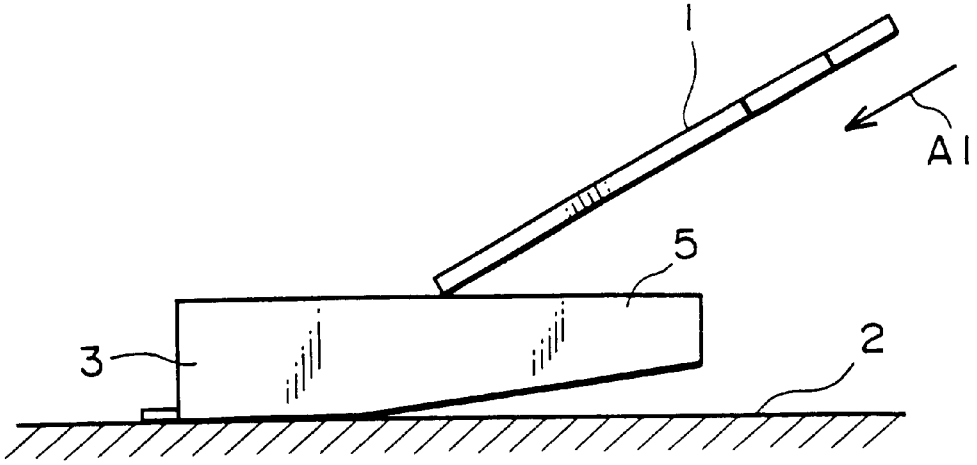
Figure 2A:
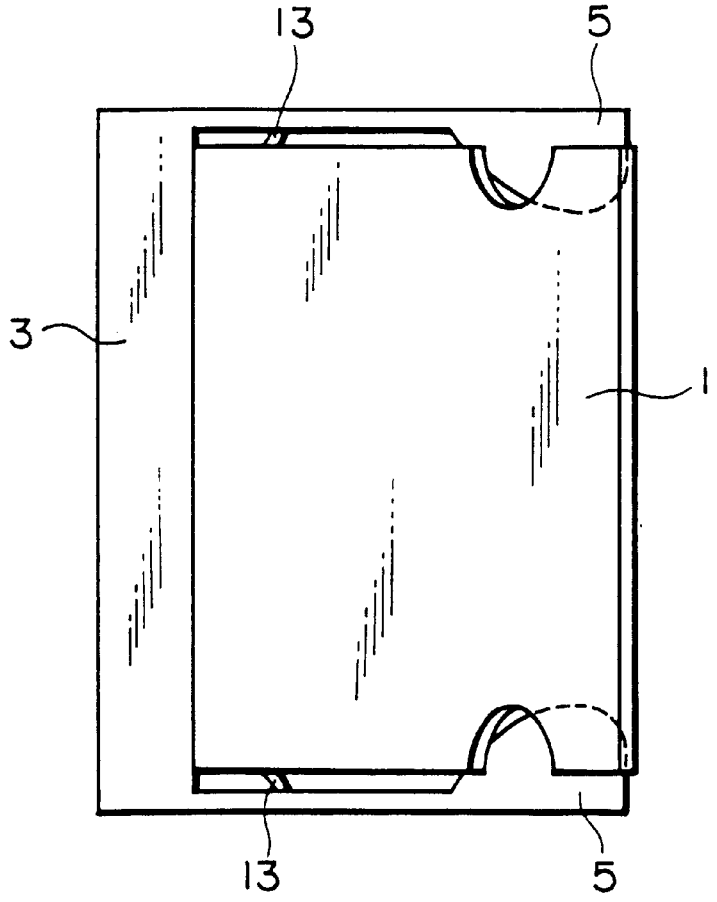
FIGS. 2A and 2B are a plan view and a side view similar to FIGS. 1A and 1B but after the small board is inserted in an inclined position, respectively.
Figure 2B:
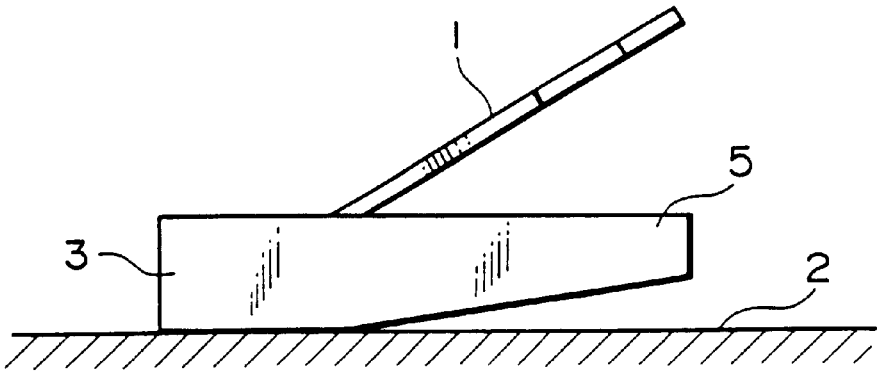
Figure 3A:
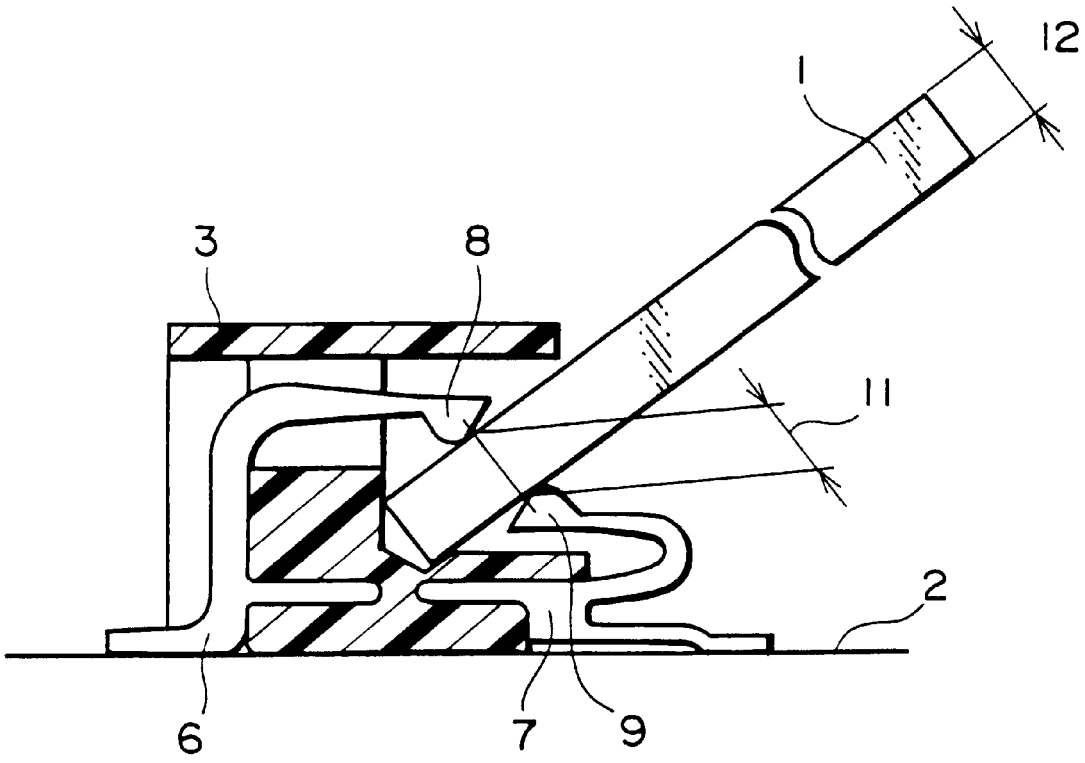
FIG. 3A is a sectional view of a characteristic part of the connector in the state illustrated in FIGS. 2A and 2B.
Figure 3B:
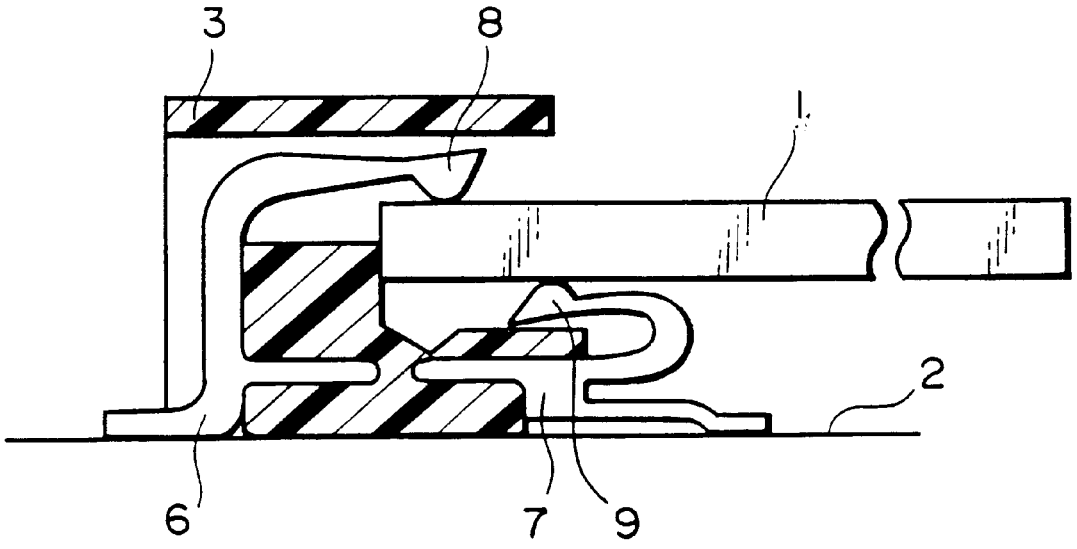
FIG. 3B is a sectional view similar to FIG. 3A but after the small board is turned into a horizontal position.

The connector illustrated in FIG. 1 is used to connect a supplementary board or a small board 1 to a large board or a main board 2. Typically, the small board 1 is provided with a memory module mounted therein. The connector comprises an insulator housing 3. The housing 3 has a coupling portion 4 which is a space for receiving the small board 1 to be inserted therein in a first direction (inclined direction) A1. The housing 3 is provided with a pair of latches 5 which are formed at opposite ends thereof in a second direction (transversal direction) A2 perpendicular to the first direction A1 and which protrude forward.

The housing 3 has a rear portion in which a plurality of first conductive contacts 6 are arranged at a predetermined pitch in the second direction A2, and a front portion in which a plurality of second conductive contacts 7 are arranged at the predetermined pitch in the second direction A2. Each of the first contacts 6 has a first contacting point 8 while each of the second contacts 6 has a second contacting point 9. In the coupling portion 4 of the housing 3, the first contacting points 8 are arranged at a distance 11 from the second contacting points 9 in one-to-one correspondence. The distance 11 is substantially equal to the thickness of the small board 1, i.e., a board thickness 12.

Furthermore, the housing 3 is provided with a pair of elastically deformable elastic members 13 formed at the opposite ends thereof in the second direction A2. When the small board 1 is inserted in the first direction A1, the elastic members 13 press opposite ends of the small board 1 in the second direction A2 to position the small board 1 exactly at the center of the coupling portion 4. Thus, the elastic members 13 serve to correct an insert position of the small board 1. For this purpose, the connector is designed so that a distance 14 between loading points of elastic members 13 is slightly smaller than a dimension of the small board 1 in the second direction A2, i.e., a board width 15.

In order to connect the small board 1 to the connector, a connecting operation is carried out in the following manner. At first, the small board 1 is inserted into the coupling portion 4 of the housing 3 in an inclined position in the first direction A1 to be faced to the first and the second contacting points 8 and 9 of the first and the second contacts 6 and 7. Since the distance 11 between the first and the second contacting points 8 and 9 of the first and the second contacts 6 and 7 is substantially equal to the board thickness 12, no substantial contacting force is produced when the small board 1 is inserted in the inclined position. Therefore, the small board 1 can be inserted with small force.

When the small board 1 is inserted, the small board 1 is butted to the elastic members 13 to elastically deform the elastic members 13. Under restoring force of the elastic members 13, the small board 1 is moved in the second direction A2 to be easily and automatically corrected in position.

Next, the small board 1 is rotated in a thickness direction around its part inserted into the housing 3, specifically, around the first and the second contacting points 8 and 9 to be turned into a horizontal position so that contacting points of the small board 1 are pressed against the first and the second contacting points 8 and 9 of the first and the second contacts 6 and 7. At this time, the contacts 6 and 7 are elastically bent. Thus, the connecting operation of connecting the small board 1 and the first and the second contacts 6 and 7 is completed. In this state, the small board 1 is applied with the contacting force of the contacts 6 and 7 to be inhibited from any further movement. However, since the small board 1 is located at a proper position when it is inserted, such inhibition of any further movement causes no problem.

In this state, the small board 1 is engaged with the housing 3 by the latches 5 to be inhibited from being released.

Figure 4:
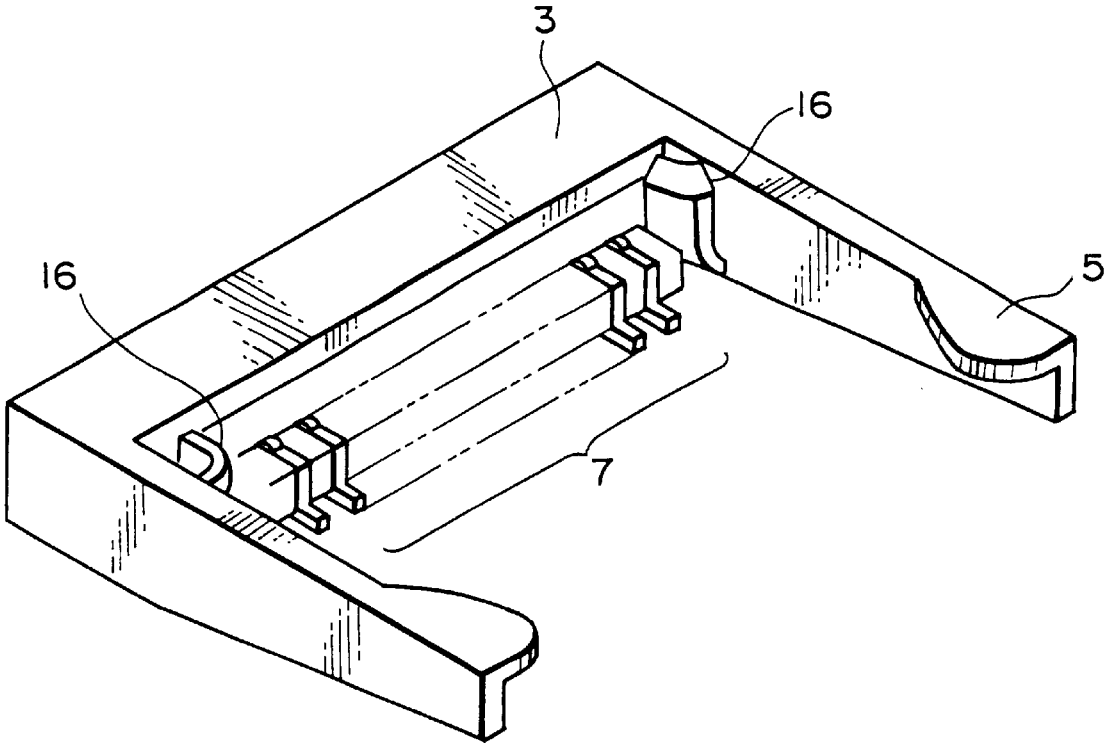
FIG. 4 is a perspective view of a connector according to a second embodiment of this invention.
Figure 5A:
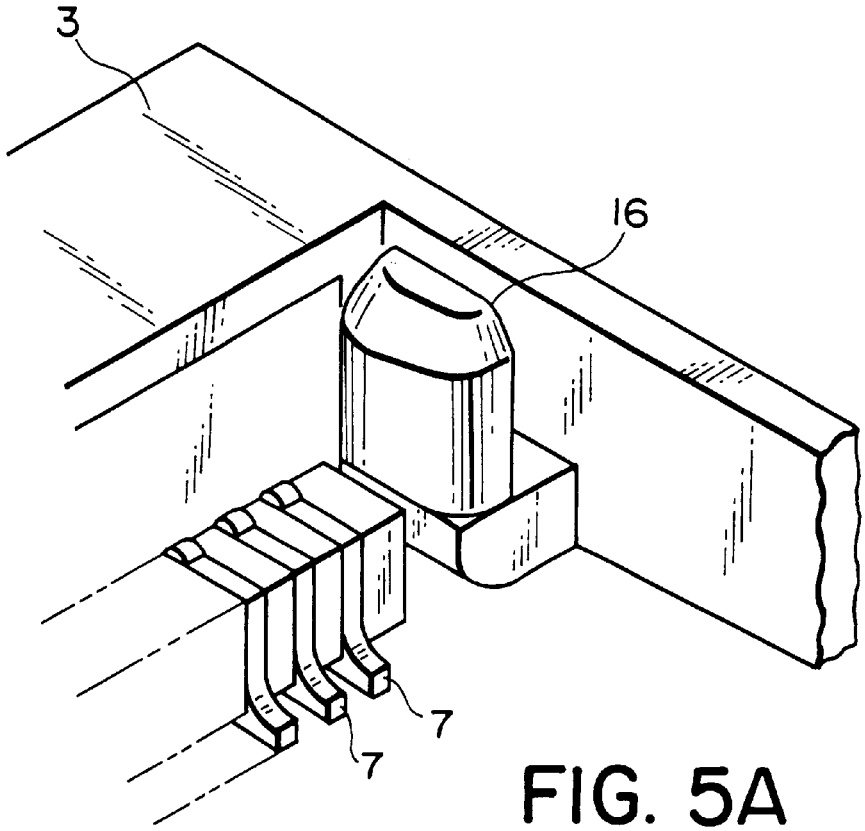
FIG. 5A is an enlarged perspective view of a characteristic part of the connector illustrated in FIG. 4 when an elastic member thereof is not applied with external force.
Figure 5B:
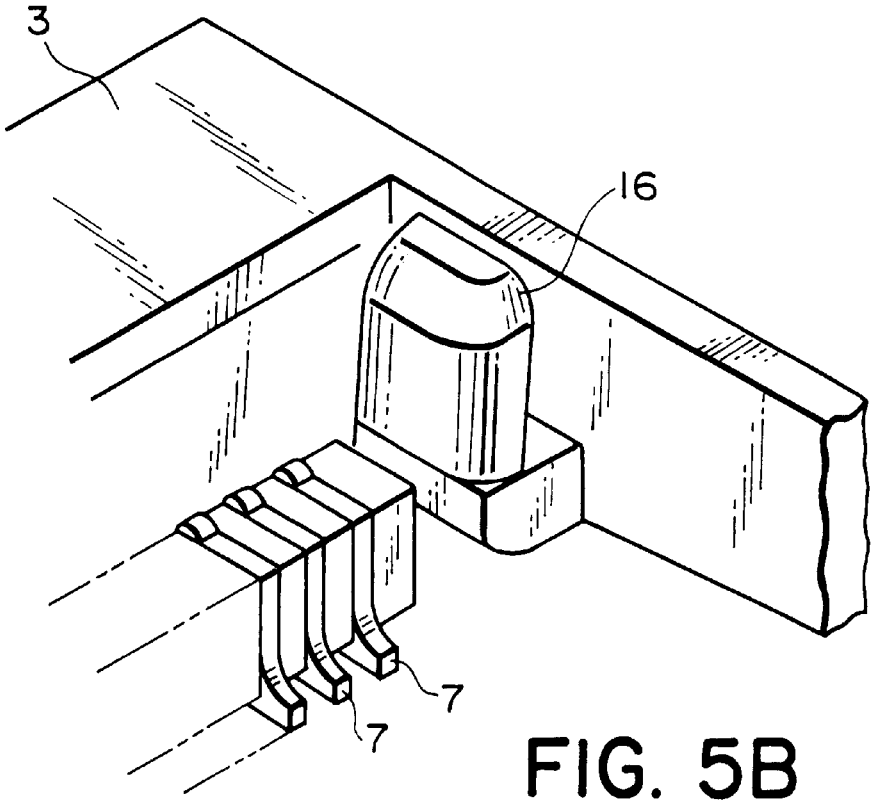
FIG. 5B is an enlarged perspective view similar to FIG. 4 but when the elastic member is elastically deformed under the external force.

Referring to FIGS. 4 through 5B, description will be made of a connector according to a second embodiment of this invention. Similar parts are designated by like reference numerals and will not be described any longer.

The connector of this embodiment has a pair of elastic members 16 corresponding to the elastic members 13 in the connector illustrated in FIGS. 1A through 3B. Each of the elastic members 16 is made of a plastic material and is integrally formed with the housing 3. In FIGS. 5A and 5B, the elastic member 16 is not applied with external force and is elastically deformed by the small board (not shown), respectively.

Figure 6A:
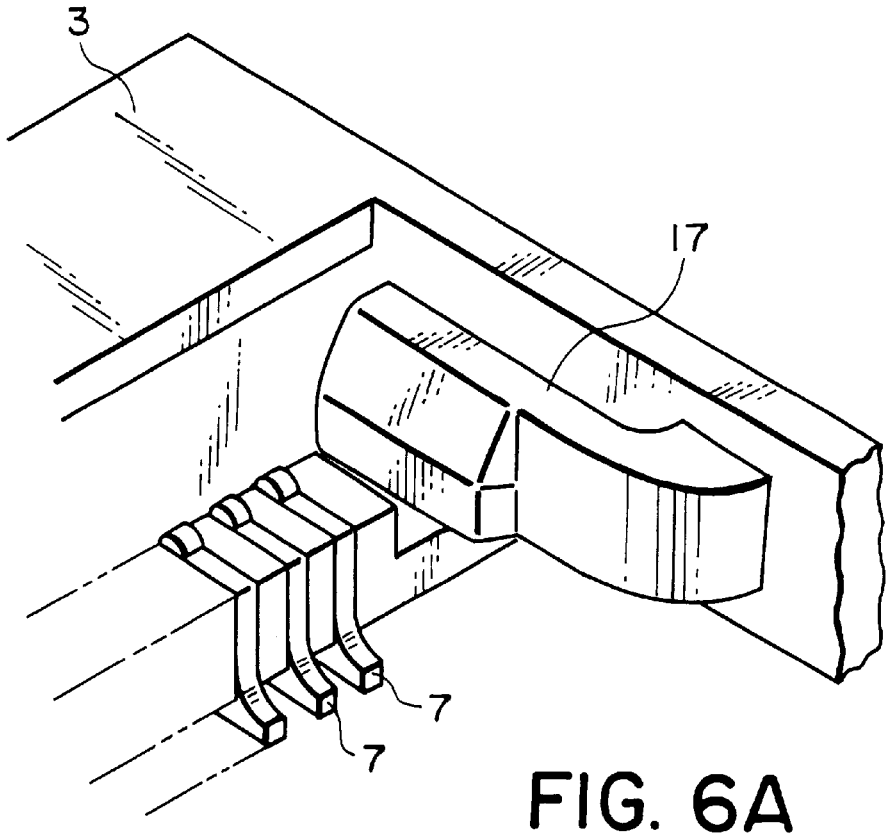
FIG. 6A is an enlarged perspective view of a characteristic part of a connector according to a third embodiment of this invention when an elastic member thereof is not applied with external force.
Figure 6B:
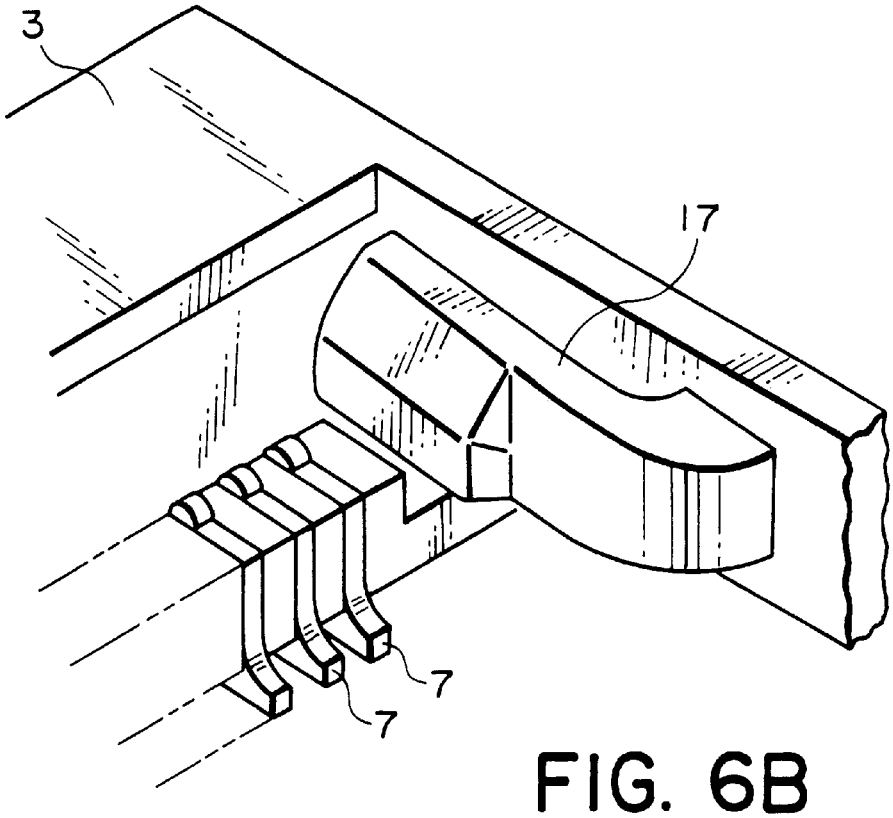
FIG. 6B is an enlarged perspective view similar to FIG. 6A but when the elastic member is elastically deformed under the external force.

Referring to FIGS. 6A and 6B, description will be made of a connector according to a third embodiment of this invention. Similar parts are designated by like reference numerals and will not be described any longer.

The connector of this embodiment has a pair of elastic members 17 corresponding to the elastic members 13 in the connector illustrated in FIGS. 1A through 3B. Each of the elastic members 17 is made of a plastic material and is integrally formed with the housing 3. However, the elastic member 17 is different in shape from the elastic member 16 illustrated in FIGS. 4 through 5B. In FIGS. 6A and 6B, the elastic member 17 is not applied with external force and is elastically deformed by the small board (not shown), respectively.

Figure 7A:
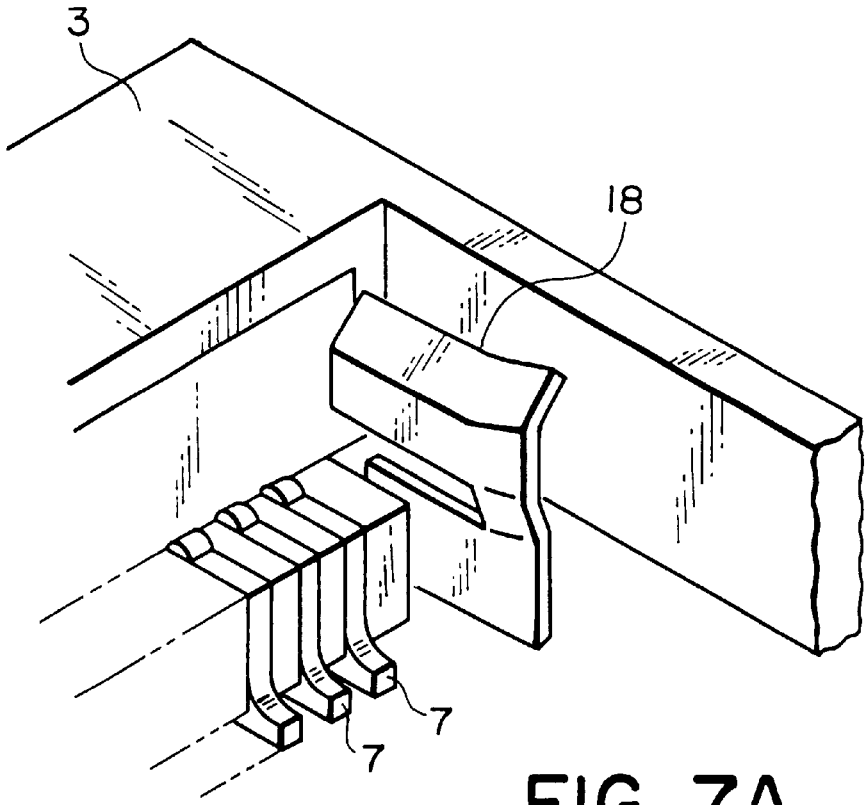
FIG. 7A is an enlarged perspective view of a characteristic part of a connector according to a fourth embodiment of this invention when an elastic member thereof is not applied with external force.
Figure 7B:
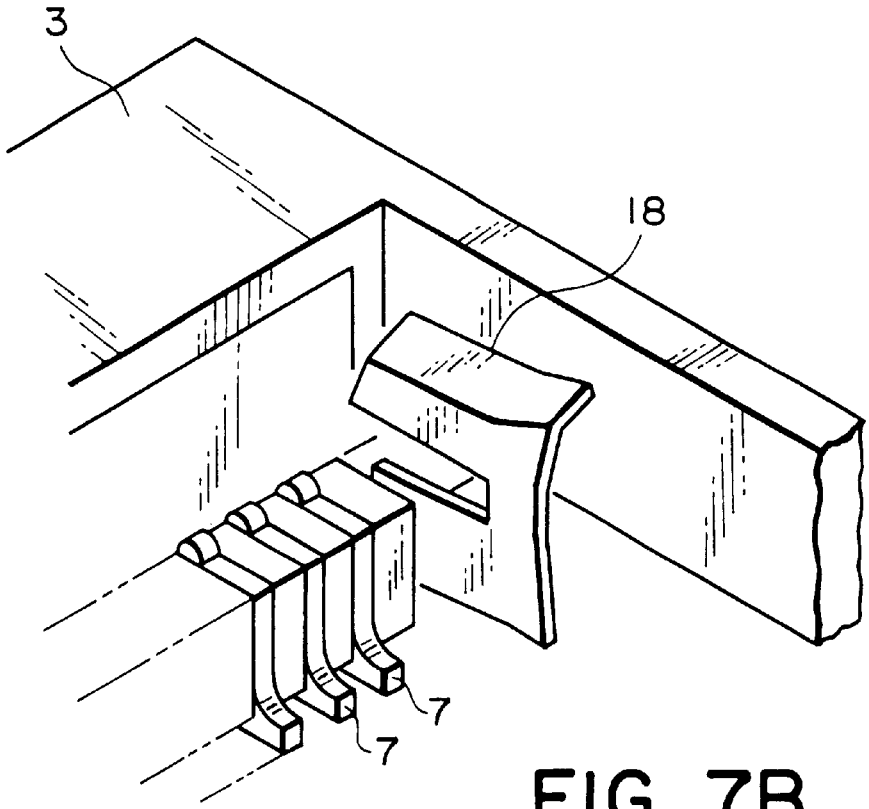
FIG. 7B is an enlarged perspective view similar to FIG. 7A but when the elastic member is elastically deformed under the external force.

Referring to FIGS. 7A and 7B, description will be made of a connector according to a fourth embodiment of this invention. Similar parts are designated by like reference numerals and will not be described any longer.

The connector of this embodiment has a pair of elastic members 18 corresponding to the elastic members 13 in the connector illustrated in FIGS. 1A through 3B. Each of the elastic members 18 is made of a metal material and is formed as an independent component separate from the housing 3. In FIGS. 7A and 7B, the elastic member 18 is not applied with external force and is elastically deformed by the small board (not shown), respectively.

Figure 8A:
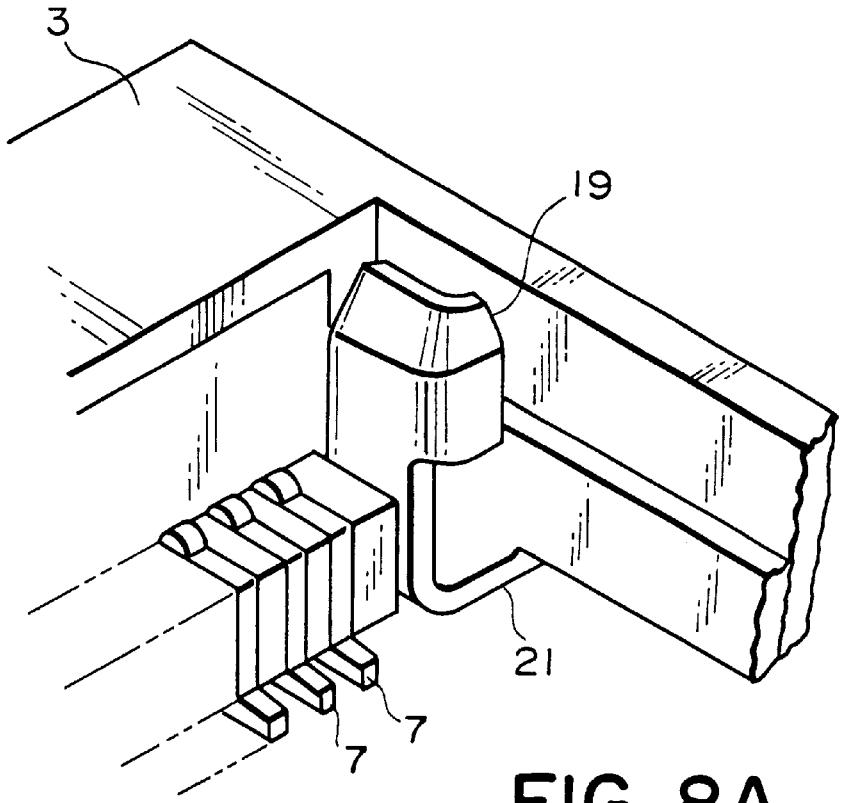
FIG. 8A is an enlarged perspective view of a characteristic part of a connector according to a fifth embodiment of this invention when an elastic member thereof is not applied with external force.
Figure 8B:
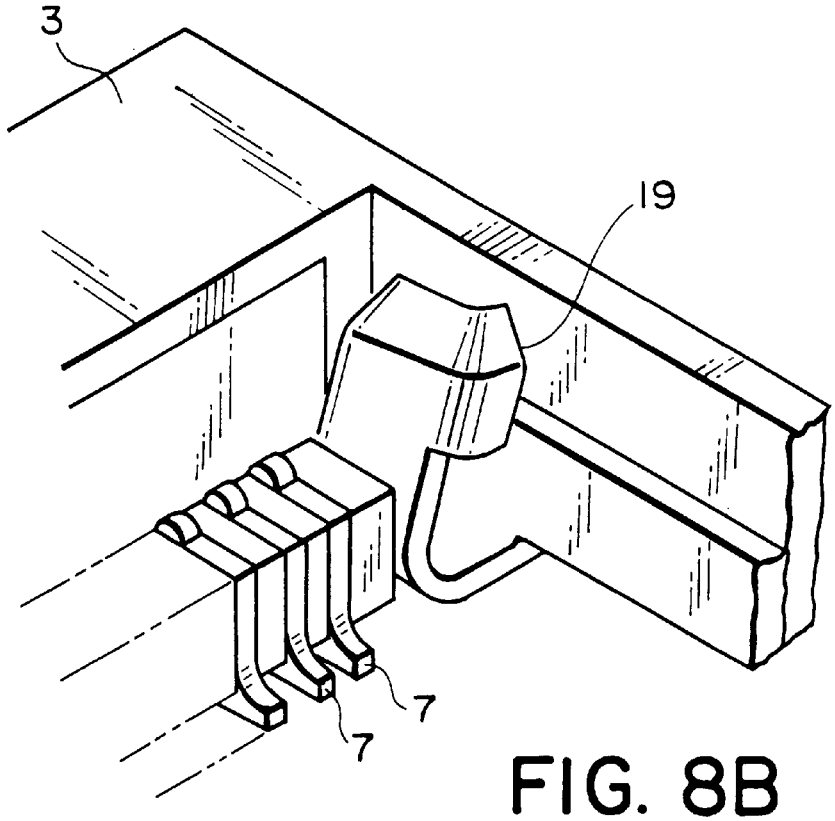
FIG. 8B is an enlarged perspective view similar to FIG. 8A but when the elastic member is elastically deformed under the external force.
Figure 9A:
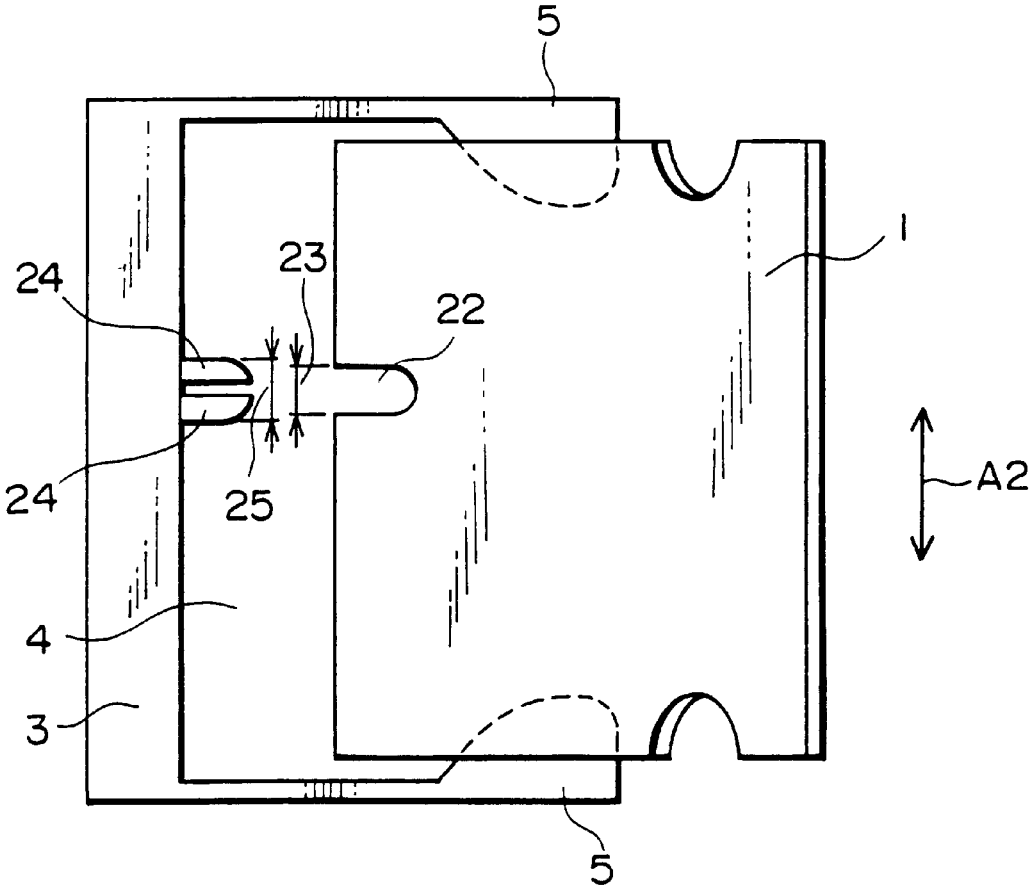
FIGS. 9A and 9B are a plan view and a side view of a connector according to a sixth embodiment of this invention before a small board is inserted therein, respectively.
Figure 9B:
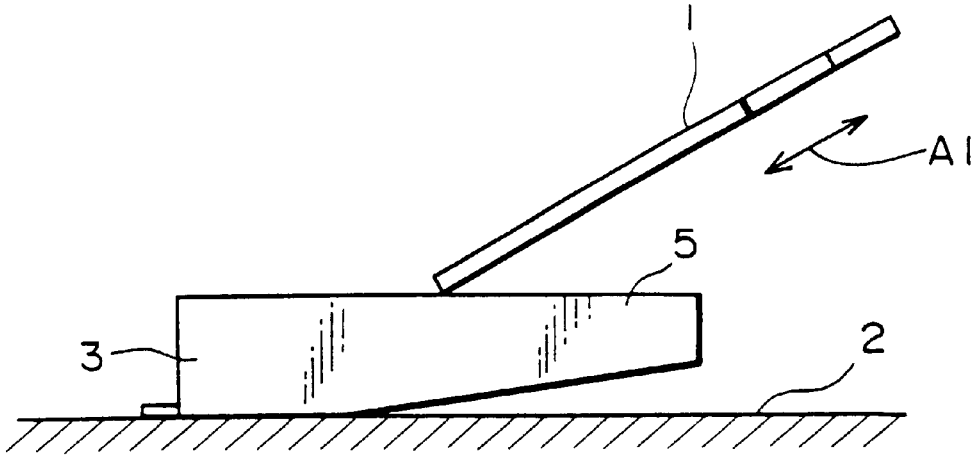
Figure 10A:
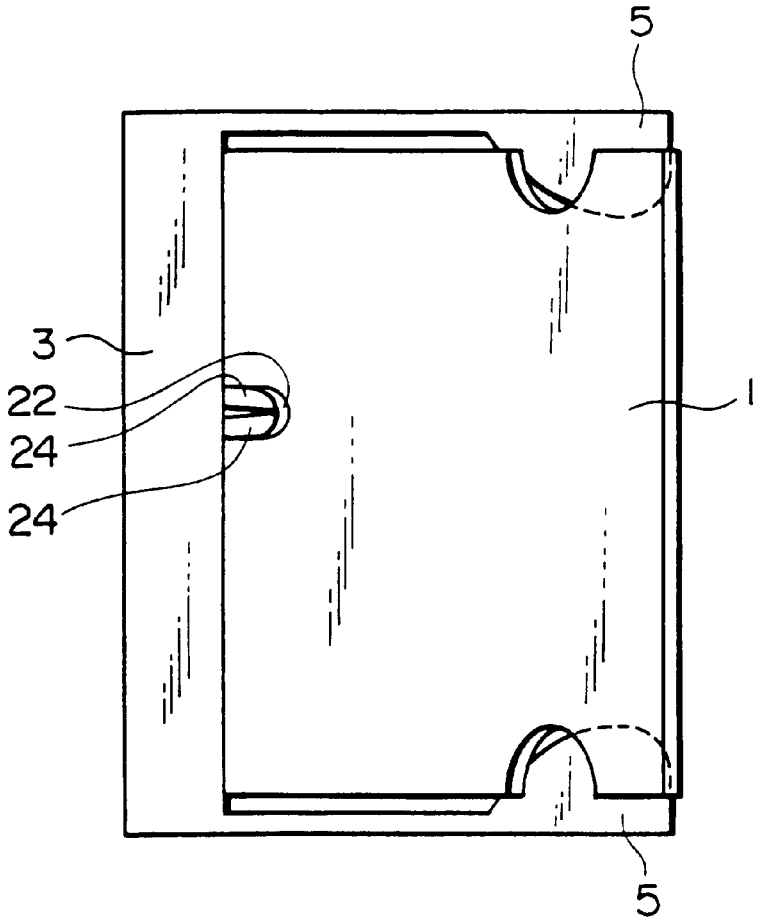
FIGS. 10A and 10B are a plan view and a side view similar to FIGS. 9A and 9B when the small board is inserted in an inclined position, respectively.
Figure 10B:
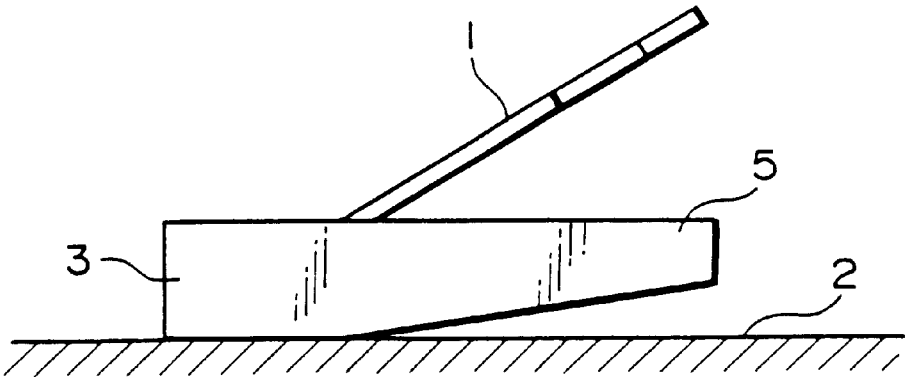
Figure 11A:
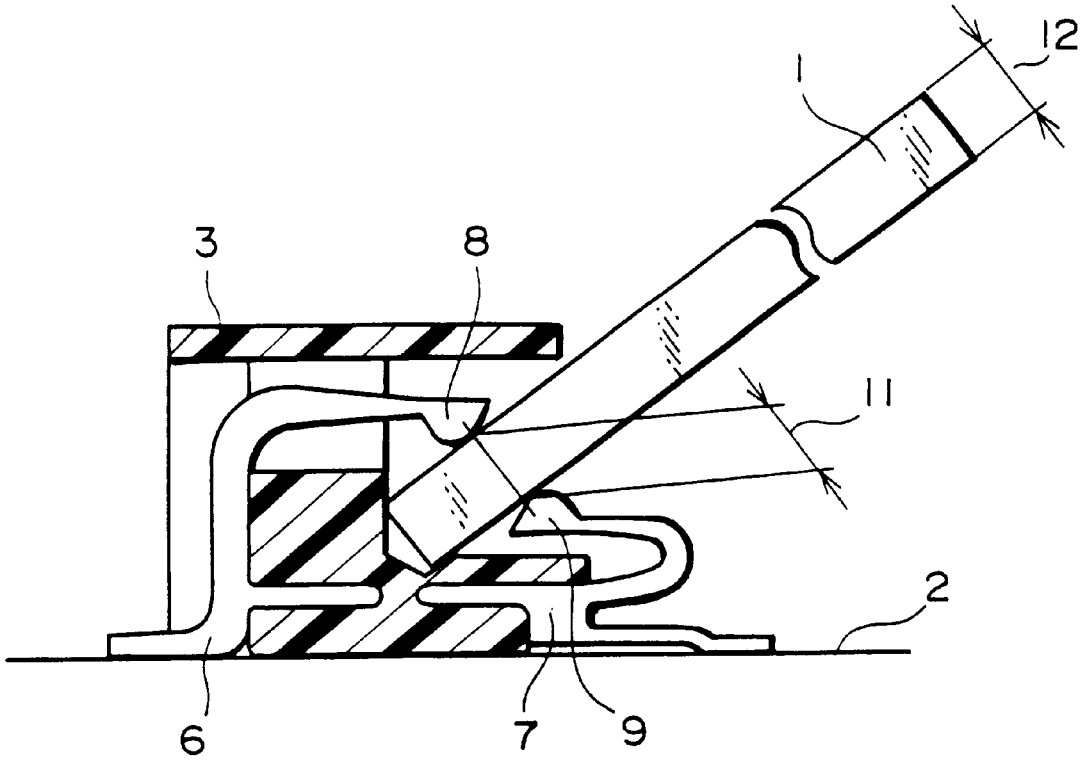
FIG. 11A is a sectional view of a characteristic part of the connector in the state illustrated in FIGS. 10A and 10B.
Figure 11B:
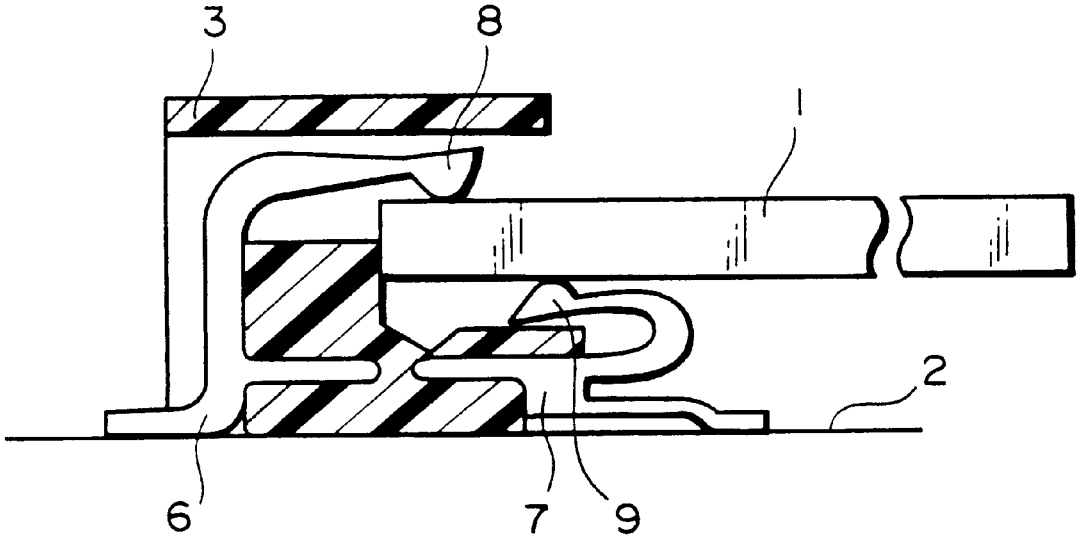
FIG. 11B is a sectional view similar to FIG. 11A but when the small board is turned into a horizontal position.

Referring to FIGS. 8A and 8B, description will be made of a connector according to a fifth embodiment of this invention. Similar parts are designated by like reference numerals and will not be described any longer.

The connector of this embodiment has a pair of elastic members 19 corresponding to the elastic members 13 in the connector illustrated in FIGS. 1A through 3B. Each of the elastic members 19 is made of a metal material and is formed as an independent component separate from the housing 3. Furthermore, the elastic member 19 is provided with a so-called hold-down portion 21 integrally formed. The hold-down portion 21 serves as a fastening member for increasing fastening strength when the connector is fastened or fixed to the main board or the like. In FIGS. 8A and 8B, the elastic member is not applied with external force and is elastically deformed by the small board (not shown), respectively.

In the foregoing embodiments, the connector is provided with a pair of elastic members to face the opposite ends of the small board in the transversal direction. Alternatively, a single elastic member may be provided to face only one end of the small board in the transversal direction while the other end of the small board in the transversal direction is guided by the housing.

Referring to FIGS. 9A through 11B, description will be made of a connector according to a sixth embodiment of this invention. Similar parts are designated by like reference numerals and will not be described any longer.

The small board 1 as an object to be connected has a key groove 22 formed at an insert end thereof. The key groove 22 is formed at a position slightly shifted from the center in the second direction A2 and has a grove width 23. Instead of the elastic members 13 formed at the opposite ends in the second direction A2, the connector has a pair of elastic members 24 which serve as a key corresponding to the key groove 22 of the small board 1. The elastic members 24 are faced to each other with a space left therebetween in the second direction A2. Each of the elastic members 24 is elastically deformable in the second direction A2. It is noted here that a distance 25 between loading points of the elastic members 24 is slightly greater than the groove width 23 of the key groove 22.

In order to connect the small board 1 to the connector, a connecting operation is carried out in the following manner. At first, the small board 1 is inserted into the coupling portion 4 of the housing 3 in the inclined position in the first direction A1 to be faced to the first and the second contacting points 8 and 9 of the first and the second contacts 6 and 7. Since the distance 11 between the first and the second contacting points 8 and 9 of the first and the second contacts 6 and 7 is substantially equal to the board thickness 12, no substantial contacting force is produced when the small board 1 is inserted in the inclined position. Therefore, the small board 1 can be inserted with small force.

When the small board 1 is inserted, the elastic members 24 are press-fitted into the key groove 22 of the small board 1 and elastically deformed. Under restoring force of the elastic members 24, the small board 1 is easily and automatically corrected in position in the second direction A2. In other words, the small board 1 is located at the center of the coupling portion 4 of the connector.

Next, the small board 1 is rotated in the thickness direction around its part inserted into the housing 3, specifically, around the first and the second contacting points 8 and 9 to be turned into a horizontal position so that the contacting points of the small board 1 are pressed against the first and the second contacting points 8 and 9 of the first and the second contacts 6 and 7. At this time, the contacts 6 and 7 are elastically bent. Thus, the connecting operation of connecting the small board 1 and the first and the second contacts 6 and 7 is completed. In this state, the small board 1 is applied with the contacting force of the contacts 6 and 7 to be inhibited from any further movement. However, since the small board 1 is located at a proper position when it is inserted, such inhibition of any further movement causes no problem.

In this state, the small board 1 is engaged with the housing 3 by the latches 5 to be inhibited from being released.

Figure 12:
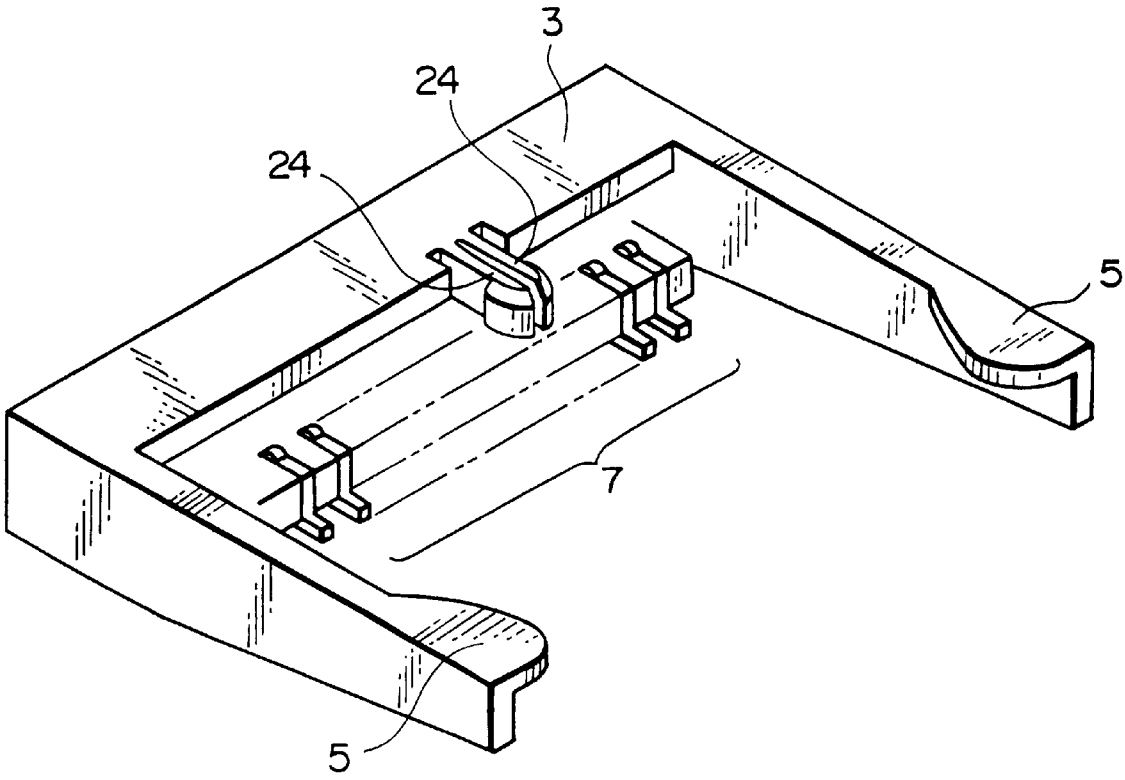
FIG. 12 is a perspective view of a modification of the connector illustrated in FIGS. 9A and 9B.
Figure 13A:
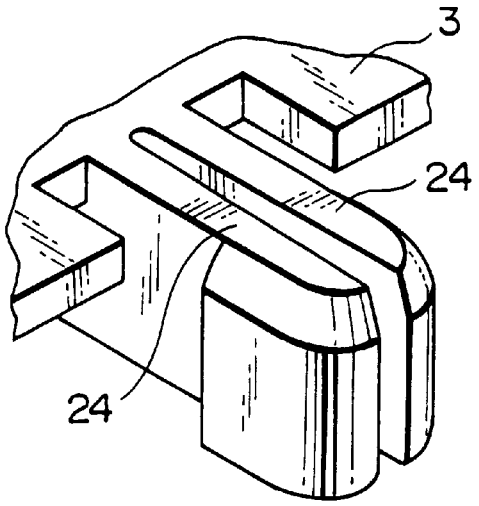
FIG. 13A is a perspective view of an elastic member of the connector illustrated in FIG. 12 before elastic deformation.
Figure 13B:
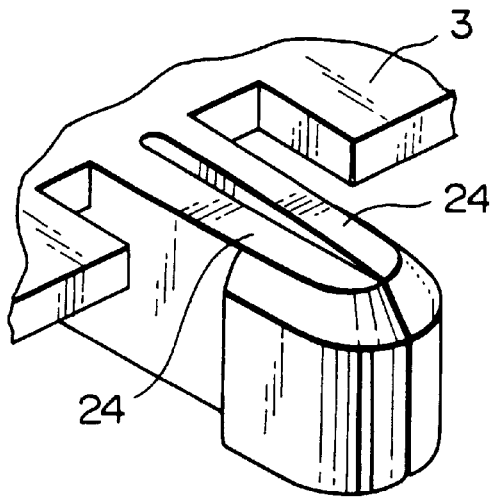
FIG. 13B is a perspective view similar to FIG. 13A but after elastic deformation.

Referring to FIG. 12, each of the elastic members 24 is made of an insulating material and is integrally formed with the housing 3. The elastic member 24 has shapes illustrated in FIGS. 13A and 13B before and after elastic deformation, respectively.

Figure 14:
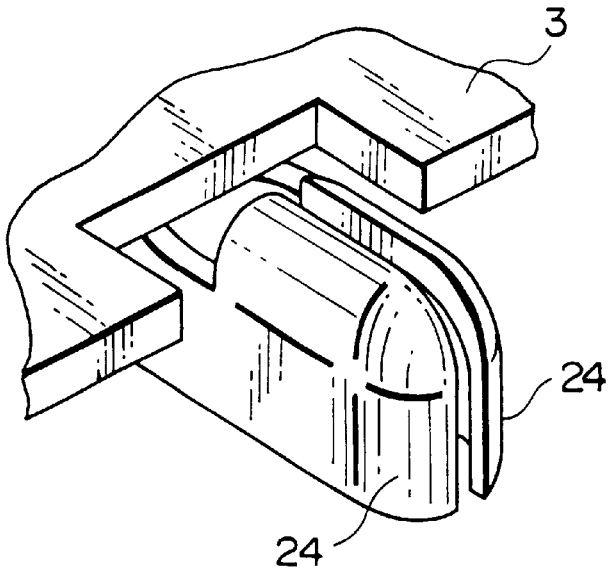
FIG. 14 is a perspective view of a characteristic part of another modification of the connector illustrated in FIGS. 9A and 9B.
Figure 15A:
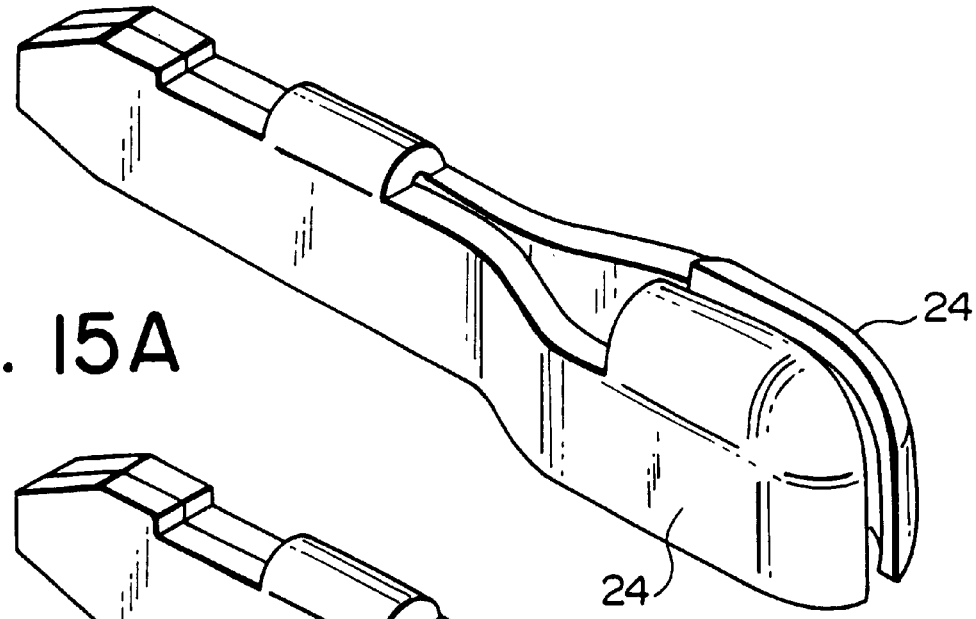
FIG. 15A is a perspective view of an elastic member used in the connector illustrated in FIG. 14 before elastic deformation.
Figure 15B:
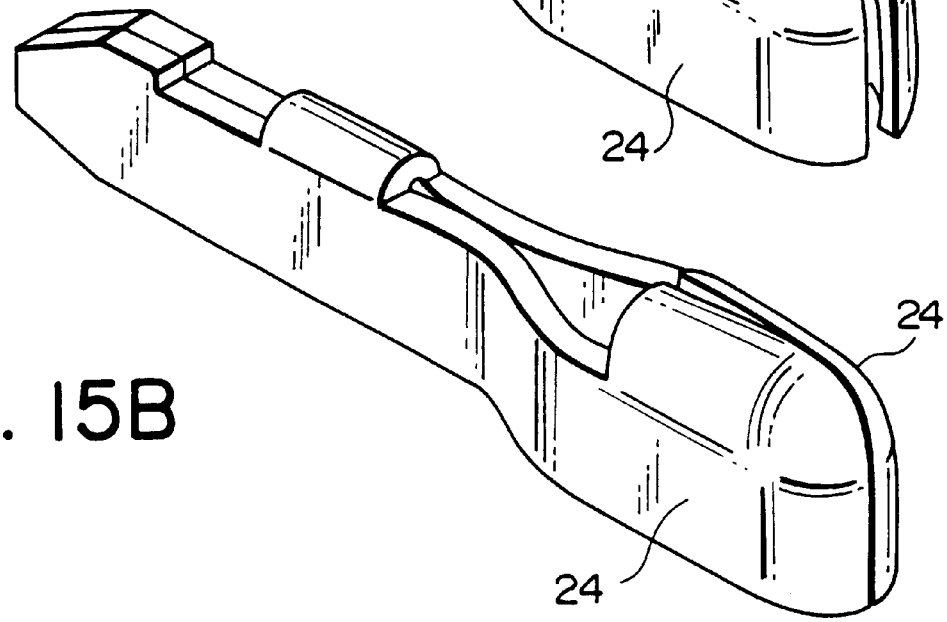
FIG. 15B is a perspective view similar to FIG. 15A but after elastic deformation.
Figure 16A:
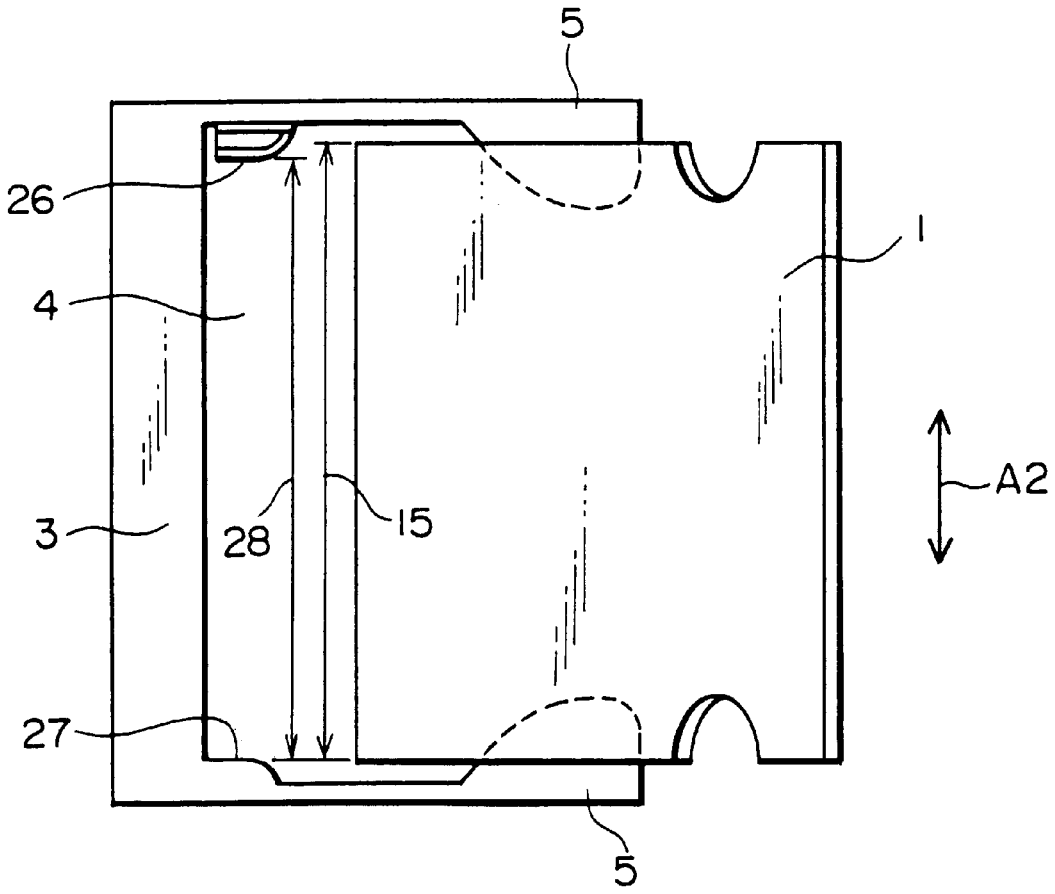
FIGS. 16A and 16B are a plan view and a side view of a connector according to a seventh embodiment of this invention before a small board is inserted therein, respectively.
Figure 16B:
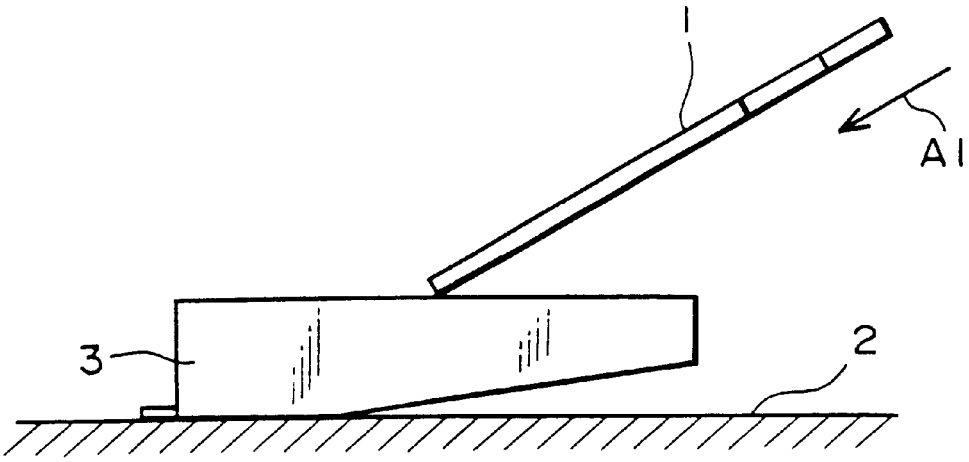
Figure 17A:
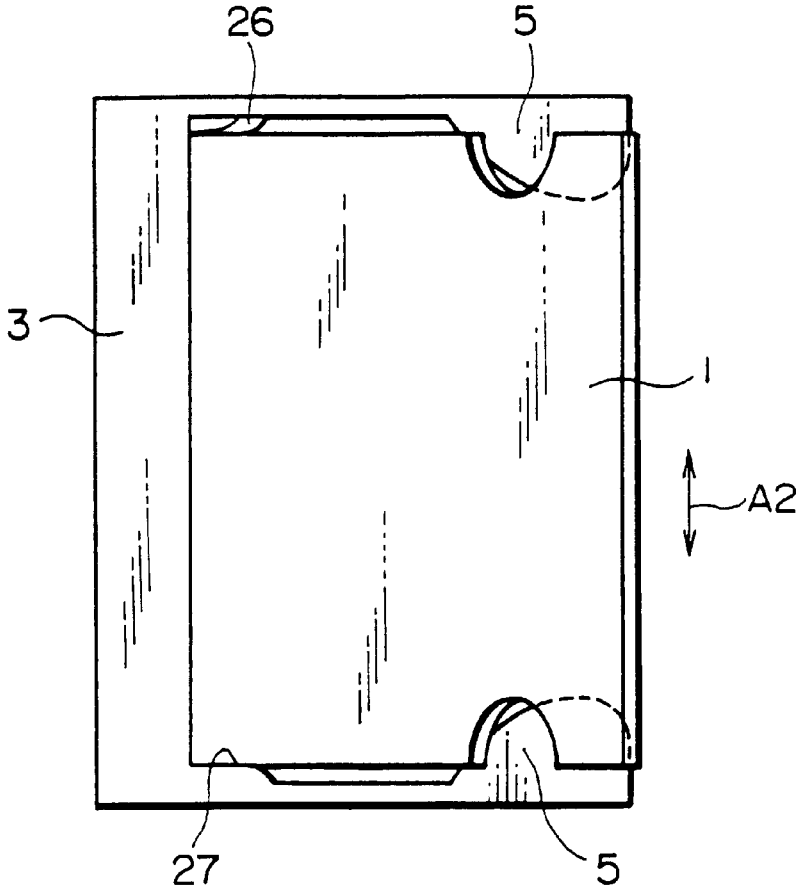
FIGS. 17A and 17B are a plan view and a side view similar to FIGS. 16A and 16B but when the small board is inserted in an inclined position, respectively.
Figure 17B:
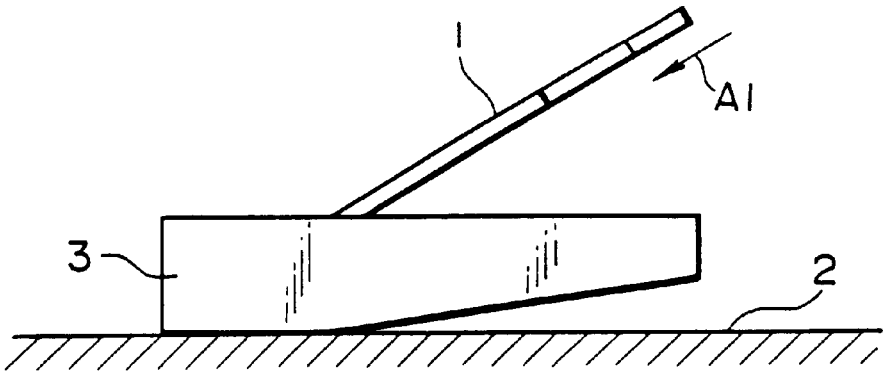

Referring to FIG. 14, each of the elastic members 24 is made of a metal material and is formed as an individual component separate from the housing 3 and fixed to the housing 3. The elastic member 24 has shapes illustrated in FIGS. 15A and 15B before and after elastic deformation, respectively.

Instead of the single key grove and the single key comprising the elastic members, a plurality of key grooves and a plurality of keys may be provided. An elastic member formed at the end and an elastic member formed at an intermediate position may be used in combination.

Referring to FIGS. 16A through 17B, description will be made of a connector according to a seventh embodiment of this invention. Similar parts are designated by like reference numerals and will not be described any longer.

The connector of this embodiment has an elastic member 26 formed in the front portion of the housing 3 only at one end in the second direction A2. At the other end of the housing 3, a stationary wall 27 is integrally formed to face the elastic member 26 in the second direction A2. When the small board 1 is inserted in the first direction A1, the elastic member 26 presses one end of the small board 1 in the second direction A2 to butt the small board 1 against the stationary wall 27 so that the small board 1 is properly positioned. Thus, the elastic member 26 serves to correct the insert position of the small board 1. For this purpose, the connector is designed so that a distance 28 between a loading point of the elastic member 26 and the stationary wall 27 is slightly smaller than the dimension of the small board 1 in the second direction A2, i.e., the board width 15.

In order to connect the small board 1 to the connector, a connecting operation is carried out in the following manner. At first, the small board 1 is inserted into the coupling portion 4 of the housing 3 in the inclined position in the first direction A1. Following the insertion of the small board 1, the small board 1 is butted to the elastic member 26 to elastically deform the elastic members 26. Under restoring force of the elastic member 26, the small board 1 is moved in the second direction A2 to be pressed against the stationary wall 27 so that the small board 1 is easily and automatically corrected in position.

Next, the small board 1 is rotated in the thickness direction around its part inserted into the housing 3 to be turned into a horizontal position. In this state, the small board 1 is inhibited from any further movement. However, since the small board 1 is located at a proper position when it is inserted, such inhibition of any further movement causes no problem.

In this state, the small board 1 is engaged with the housing 3 by the latches 5 to be inhibited from being released.

In this embodiment, even if the coupling portion 4 is slightly greater or smaller in size than the small board 1, the small board 1 is properly positioned in contact with the stationary wall 27 of the coupling portion 4. In addition, shaking movement is absorbed. Therefore, a pitch error due to the variation in size of the small board 1 is minimized so that a contact failure is prevented.

Figure 18B:
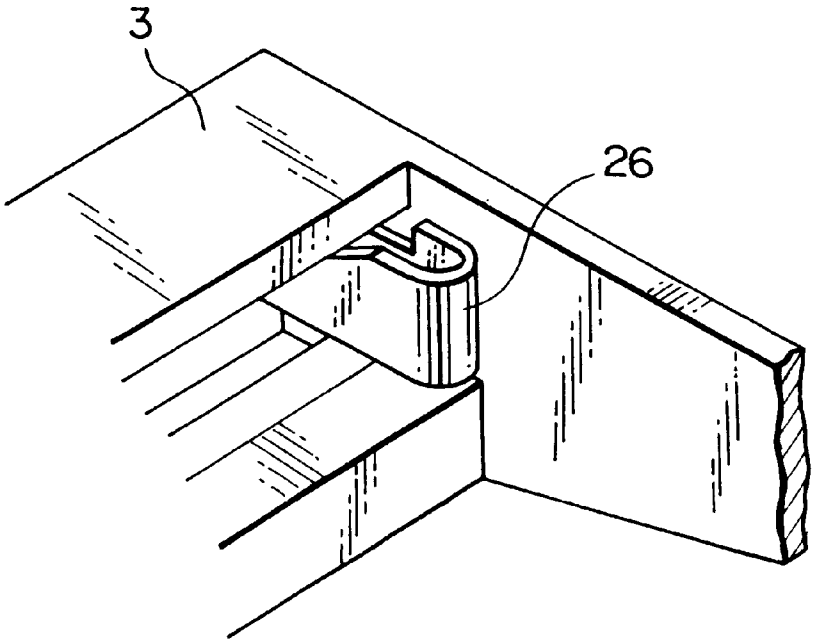
FIG. 18B is a perspective view similar to FIG. 18A but after the elastic member is fitted into the housing.
Figure 18A:
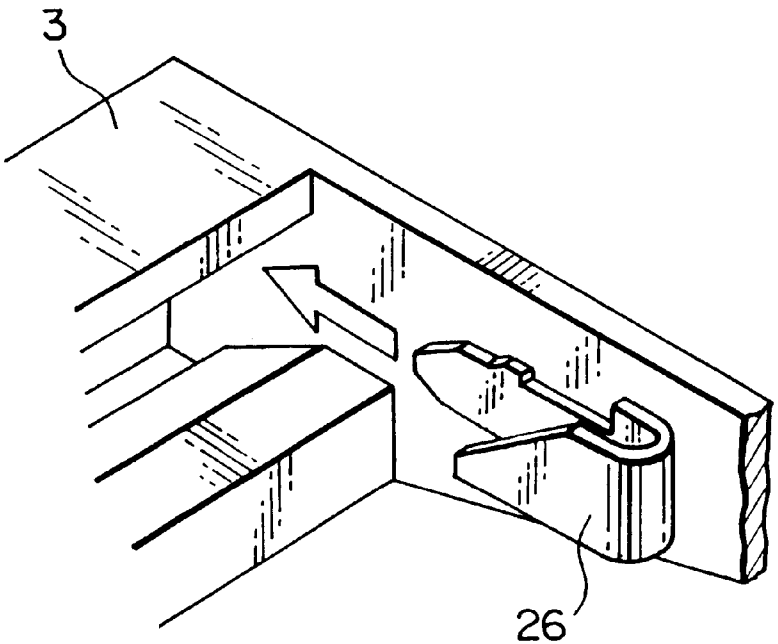
FIG. 18A is a perspective view showing a part of the connector illustrated in FIGS. 16A and 16B before an elastic member is fitted into a housing.

The elastic member 26 is made of a metal material. As illustrate in FIGS. 18A and 18B, the elastic member 26 is fitted into the housing 3 and fixed thereto.

Figures 19A, 19B:
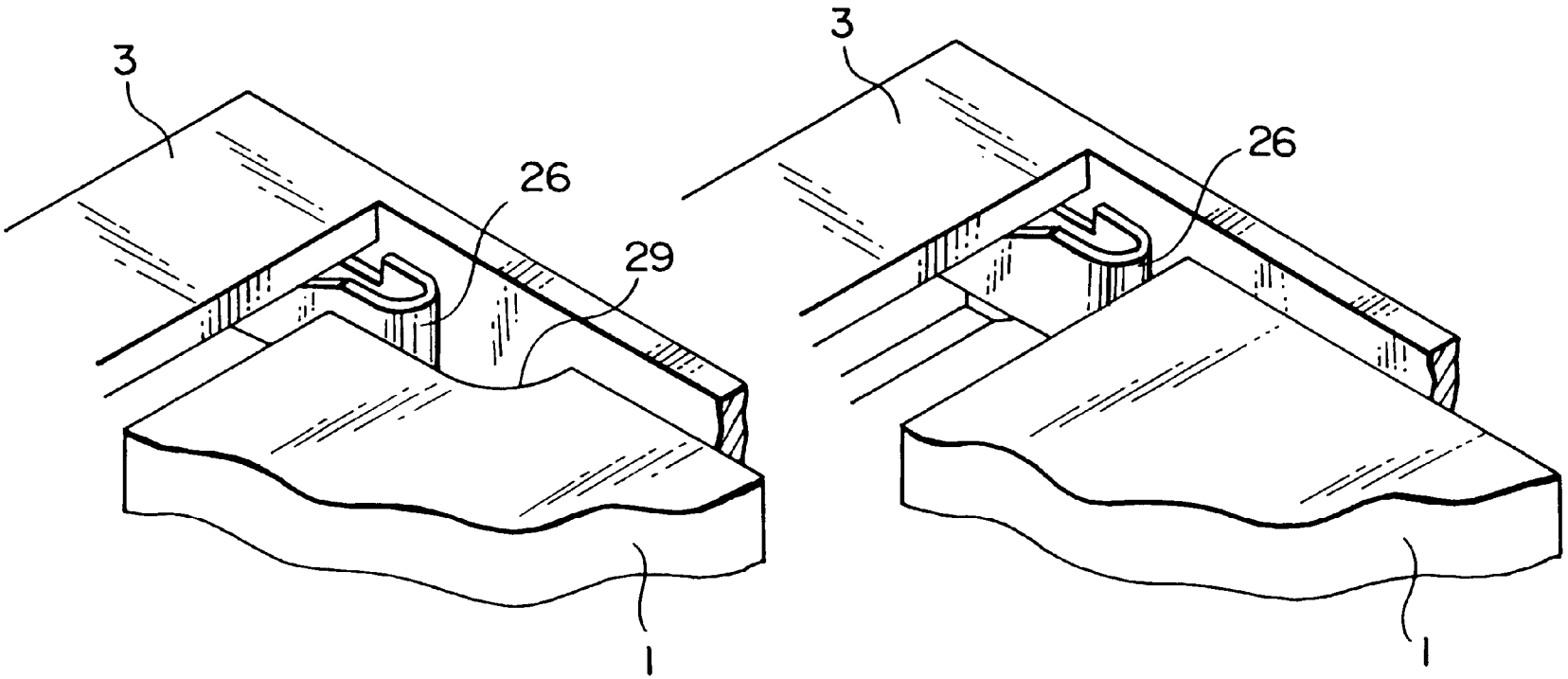
FIG. 19A is a perspective view showing a part of the connector illustrated in FIGS. 16A and 16B in relation to a small board which can be connected thereto.
FIG. 19B is a perspective view similar to FIG. 19A but in relation to another small board which can not be connected thereto.

Referring to FIGS. 19A and 19B, an elastic member 27 has a key function. As illustrated in FIG. 19A, the small board as an object to be connected is provided with a recess 29 formed at its end. The small board 1 can be inserted into the coupling portion 4 of the housing 3 as far as the small board 1 has the recess 29. On the other hand, the small board 1 can not be inserted into the coupling portion 4 of the housing 3 if the small board 1 does not have the recess 29 as illustrated in FIG. 19B. This structure is advantageous in view of miniaturization of the connector because no special key is required.

Figure 20:
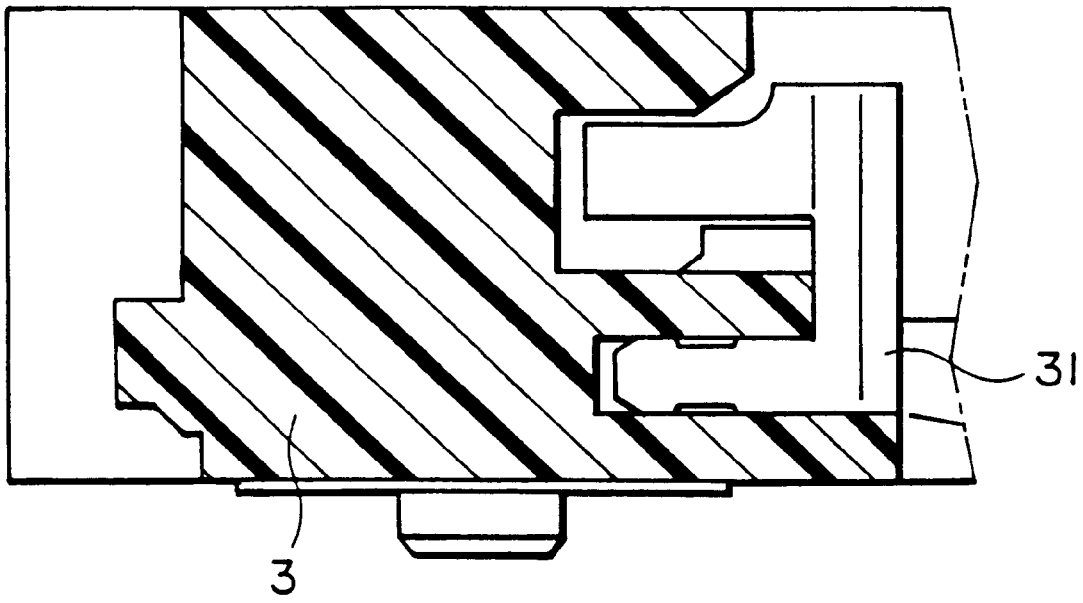
FIG. 20 is a sectional view of a characteristic part of still another modification of the connector illustrated in FIGS. 9A, 9B, 10A, and 10B.
Figure 21:
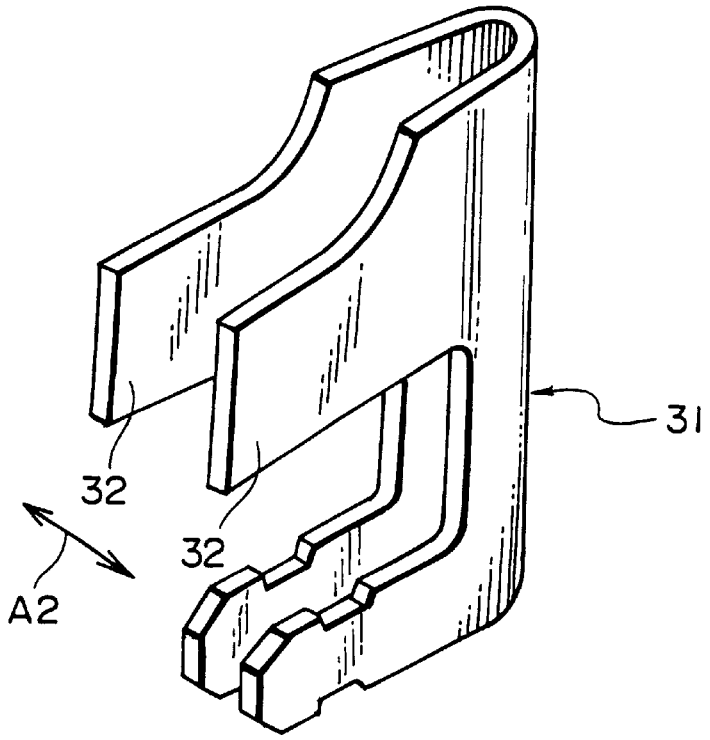
FIG. 21 is a perspective view of an elastic member used in the connector illustrated in FIG. 20.
Figure 22:
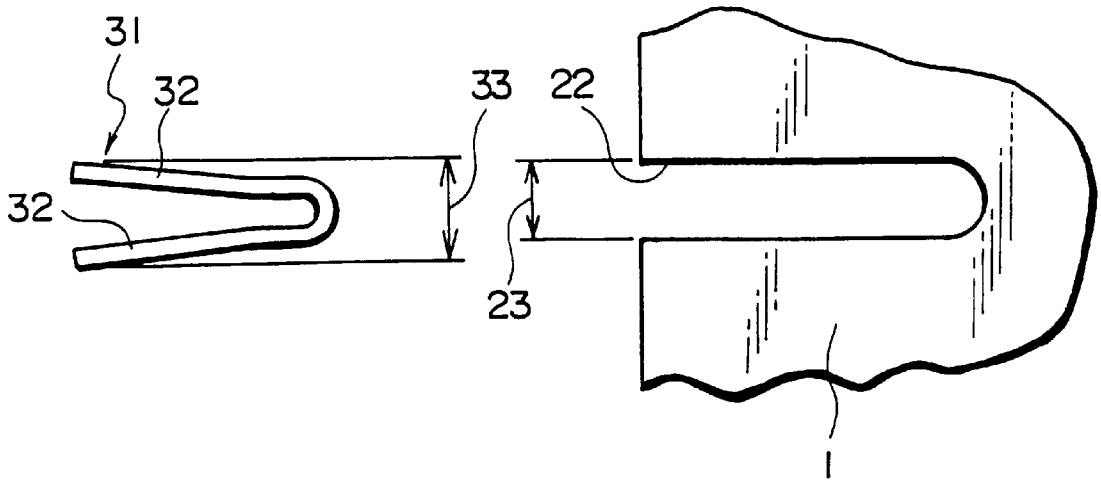
FIG. 22 is a view showing the elastic member in FIG. 21 in relation to a small board.

Referring to FIGS. 20 through 22, description will be made of a still further modification of the connector illustrated in FIGS. 9A through 10B.

As illustrated in FIG. 20, the housing 3 is provided with an elastic member 31 made of a metal material. The elastic member 31 is formed as a separate component and fixed to the housing 3. As illustrated in FIG. 21, the elastic member 31 has a pair of spring portions 32 faced to each other in the second direction A2. When the small board 1 is inserted into the connector, the spring portions 32 are inserted into the key groove 22 of the small board 1 to exhibit a key function. As illustrated in FIG. 22, a distance between loading points of the spring portions 32 is slightly greater than the width of the key groove 22.

In any one of the connectors mentioned above, the elastic member exhibits its function under no or very small contacting force of the contacts in the state where the small board is inserted in the inclined position. Therefore, the restoring force of the elastic member successfully acts to assure proper positioning of the small board. Since the small board is properly positioned by the elastic member when it is inserted in the inclined position, the small board is located exactly at the center of the coupling portion of the connector even if the size of the coupling portion is slightly greater or smaller. As a consequence, it is possible to minimize the pitch error due to the variation in size of the small board so that a contact failure is avoided. In addition, since the tolerance of the outer dimension of the board can be less strict, it is possible to reduce the production cost of the small board. With respect to the connector also, the production cost can be reduced because the tolerance in size of the coupling portion can be less strict.

What is claimed is:

1. A connector for connecting a small board inserted into said connector in a first direction, said small board being rotated in a thickness direction around a part thereof which is inserted into said connector, said connector comprising:

an insulator housing for receiving therein said part of the small board in said first direction;

an elastic member held by said housing and having elasticity in a second direction intersecting with said first and said thickness direction, said elastic member being engaged with said small board to position said small board in said second direction when said part of the small board is received in said first direction with in said insulator housing; and an electroconductive contact held by said housing to face said small board in said thickness direction with said small board being rotated around said part in said thickness direction after received in said insulator in said first direction.

2. The connector according to claim 1, wherein said elastic member presses at least one of opposite ends of said small board in said second direction when said small board is inserted.

3. The connector according to claim 1, wherein said small board has a key groove, said elastic member being inserted into said key groove when said small board is received in said insulator housing.

4. The connector according to claim 1, wherein said elastic member is made of an insulating material and is formed integral with said housing.

5. The connector according to claim 1, wherein said elastic member is made of a metal material and is formed as an individual component separate from said housing and fixed to said housing.

6. The connector according to claim 5, further comprising a fastening member formed integral with said elastic member, said fastening member serving to fasten said connector.

* * * * *